US008911830B2

(12) United States Patent
Qi et al.

(10) Patent No.: US 8,911,830 B2
(45) Date of Patent: Dec. 16, 2014

(54) METHOD OF FORMING A FLUOROPLASTIC TOPCOAT INCLUDING CARBON NANOTUBES

(71) Applicant: Xerox Corporation, Norwalk, CT (US)

(72) Inventors: Yu Qi, Oakville (CA); Qi Zhang, Milton (CA); Nan-Xing Hu, Oakville (CA)

(73) Assignee: Xerox Corporation, Norwalk, CT (US)

( * ) Notice: Subject to any disclaimer, the term of this patent is extended or adjusted under 35 U.S.C. 154(b) by 22 days.

(21) Appl. No.: 13/871,702

(22) Filed: Apr. 26, 2013

(65) Prior Publication Data

US 2014/0322447 A1 Oct. 30, 2014

(51) Int. Cl.
*B05D 3/02* (2006.01)
*G03G 15/20* (2006.01)

(52) U.S. Cl.
CPC ..... *G03G 15/20* (2013.01)
USPC ..... 427/384; 427/226; 427/227; 427/379

(58) Field of Classification Search
None
See application file for complete search history.

(56) References Cited

U.S. PATENT DOCUMENTS

| | | | | |
|---|---|---|---|---|
| 2011/0123732 | A1 | 5/2011 | Foley et al. | |
| 2012/0202932 | A1 * | 8/2012 | Zhang et al. | 524/157 |
| 2012/0224897 | A1 | 9/2012 | Qi et al. | |
| 2013/0017005 | A1 | 1/2013 | Zhang et al. | |
| 2013/0116369 | A1 * | 5/2013 | Qi et al. | 524/157 |
| 2014/0147180 | A1 * | 5/2014 | Qi et al. | 399/333 |

* cited by examiner

*Primary Examiner* — Erma Cameron
(74) *Attorney, Agent, or Firm* — MH2 Technology Law Group LLP

(57) ABSTRACT

A method for forming a surface topcoat can include mixing a plurality of carbon nanotubes (CNT) with a thermally decomposable polymer binder to form a thermally decomposable polymer composite. The thermally decomposable polymer composite is mixed with a plurality of fluoroplastic particles, a fluorinated surfactant, and a solvent media to form a coating dispersion. Next, the coating dispersion is applied to a substrate such as a printer fuser member substrate to form a coated substrate. The coated substrate is heated to cure the coating dispersion to form a final coating film on the substrate.

18 Claims, 1 Drawing Sheet

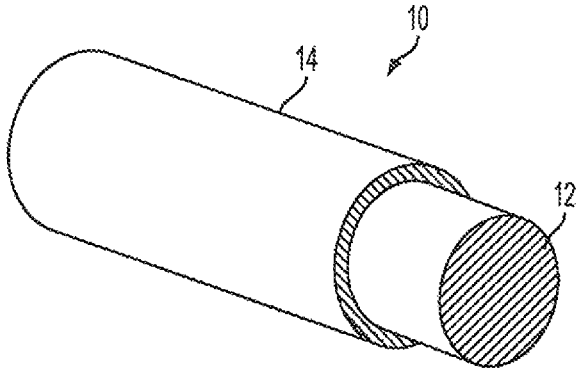
10
14
12

METHOD OF FORMING A FLUOROPLASTIC TOPCOAT INCLUDING CARBON NANOTUBES

FIELD OF THE EMBODIMENTS

The present teachings relate generally a fuser members used in electrophotographic printing devices and, more particularly, to a method for forming a fluoroplastic topcoat including carbon nanotubes used as a topcoat layer of the fuser member.

BACKGROUND OF THE EMBODIMENTS

In a typical electrophotographic reproducing apparatus, a light image of an original to be copied is recorded in the form of an electrostatic latent image upon a photosensitive member. The latent image is subsequently rendered visible by application of electroscopic thermoplastic resin particles which are commonly referred to as toner. The visible toner image is then in a loose powdered form and is usually fused, using a fusing apparatus, upon a support, which may be an intermediate member, or a print medium such as plain paper.

Conventional fusing apparatuses may include a fuser member and a pressure member, which can be configured to include a roll pair maintained in pressure contact or a belt member in pressure contact with a roll member. In a fusing process, heat may be applied by heating one or both of the fuser member and the pressure member.

Some conventional fusing technologies may include the application of fuser oils to the fuser member during the fusing operation, in order to maintain good releasing properties of the fuser member. Other technologies may include an oil-less fusing process, which omits the oil application step from the fusing operations. Oil-less fusing operations have been used for color printers and multi-functional copier-printers in small office and home office market but not for all high speed products.

A fuser member may include a topcoat to achieve target levels of thermal and/or electrical conductivity. For example, a topcoat can include carbon nanotubes (CNT) dispersed within a fluoroelastomer. To form the coating, CNT powder can be dispersed into a fluoroelastomer using, for example, extrusion blending. CNT powder is soluble within fluoroelastomers. A topcoat is disclosed, for example, in USPGP 2013/0017005, which is incorporated herein by reference in its entirety.

Fluoroplastics may also demonstrate desirable thermal and electrical conductivity for some uses as a coating, for example as a topcoat for a printer fuser member. However, CNT powder is insoluble in fluoroplastics. Attempts at extrusion blending CNT powder into a fluoroplastic can result in CNT being dispersed into the air, thereby resulting in health and safety concerns.

A method for safely forming a coating, such as a fuser member topcoat including a CNT dispersed within a fluoroplastic, would be desirable.

SUMMARY OF THE EMBODIMENTS

The following presents a simplified summary in order to provide a basic understanding of some aspects of one or more embodiments of the present teachings. This summary is not an extensive overview, nor is it intended to identify key or critical elements of the present teachings nor to delineate the scope of the disclosure. Rather, its primary purpose is merely to present one or more concepts in simplified form as a prelude to the detailed description presented later.

In an embodiment of the present teachings, a method for forming a low surface energy coating can include mixing a plurality of carbon nanotubes with a thermally decomposable polymer binder to form a thermally decomposable polymer composite, mixing the thermally decomposable polymer composite with a plurality of fluoroplastic particles, a fluorinated surfactant, and a solvent media to form a coating dispersion, applying the coating dispersion onto a substrate to form a coated substrate, and heating the coated substrate to cure the coating dispersion to form a final coating film on the substrate.

Another embodiment of the present teachings can include a method for forming a printer fuser member comprising a topcoat. The topcoat can be formed using a method including mixing a plurality of carbon nanotubes with a thermally decomposable polymer binder to form a thermally decomposable polymer composite, mixing the thermally decomposable polymer composite with a plurality of fluoroplastic particles, a fluorinated surfactant, and a solvent media to form a coating dispersion, applying the coating dispersion onto a substrate to form a coated substrate, and heating the coated substrate to cure the coating dispersion to form a final coating film on the substrate.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures:

FIG. 1 is a schematic perspective depiction of a fuser member including a topcoat formed using an embodiment of the present teachings.

It should be noted that some details of the FIGS. have been simplified and are drawn to facilitate understanding of the present teachings rather than to maintain strict structural accuracy, detail, and scale.

DESCRIPTION OF THE EMBODIMENTS

Reference will now be made in detail to exemplary embodiments of the present teachings, examples of which are illustrated in the accompanying drawings. Wherever possible, the same reference numbers will be used throughout the drawings to refer to the same or like parts.

As used herein, unless otherwise specified, the word "printer" encompasses any apparatus that performs a print outputting function for any purpose, such as a digital copier, bookmaking machine, facsimile machine, a multi-function machine, electrostatographic device, etc. Unless otherwise specified, the term "fluoroelastomer" refers to a class of elastomers including copolymers of hexafluoropropylene and vinylidene fluoride, terpolymers of tetrafluoroethylene, vinylidene fluoride and hexafluoropropylene as well as perfluoromethylvinylether containing materials. The fluorine content of the most common grades of fluoroelastomers varies between 66% and 70%. Unless otherwise specified, the term "fluoroplastic" encompasses any of the plastics in which some or all hydrogen atoms of the hydrocarbon chains are replaced by fluorine atoms.

Fluoroplastics may demonstrate desirable thermal conductivity, electrical conductivity, and release properties that make them desirable for use as a coating, for example as a coating for a printer fuser member such as a fuser roll or a fuser belt. To tailor these properties, it may be desirable to disperse a plurality of carbon nanotubes (CNT) within a liquid fluoroplastic, and then coat the resulting mixture onto a fuser member. However, CNT powder is insoluble in fluoroplastics. Attempts at extrusion blending CNT powder into a fluoroplastic can result in CNT being dispersed into the air as freestanding CNT powder, thereby resulting in health and safety concerns.

An embodiment of the present teachings can include a method for forming a fluoroplastic coating including a plurality of CNT dispersed therein. A surface such as a printer fuser member may then be coated with a liquid fluoroplastic/CNT mixture, which is then cured to a solid state to form a solid coating including fluoroplastic and CNT.

An embodiment of the present teachings can include a method for forming a printer fuser member topcoat. In an embodiment, a plurality of CNT, for example CNT powder, is mixed and dispersed into a material within which the CNT power is soluble. Because CNT powders are not readily soluble within fluoroplastics, the plurality of CNT is dispersed within a non-fluoroplastic binder material, such as a thermally decomposable polymer binder, to form a thermally decomposable polymer composite (i.e., a CNT/PAC mixture). In an embodiment, the thermally decomposable polymer binder may be a poly(alkylene carbonate) (i.e., "PAC"). In an embodiment, the PAC may be include poly(propylene carbonate) (PPC), for example liquid PPC, poly(ethylene carbonate), poly(butylene carbonate), poly(cycloxene carbonate), and mixtures thereof. The CNT may be mixed with the thermally decomposable polymer binder using a high shear mixing process, for example using a high shear mixer.

In an embodiment, the CNT and the plurality of fluoroplastic particles can be mixed such that the CNT ranges from between about 0.5 wt % to about 15 wt % of the fluoroplastics particles. In other words, comparing the CNT and the fluoroplastic particles within the thermally decomposable polymer composite (ignoring any other components), the wt % of the CNT is between about 0.5 wt % and about 15 wt % and the wt % of the plurality of fluoroplastic particles is between about 85 wt % and about 99.5 wt %. In an embodiment, the thermally decomposable polymer composite may include between about 1 wt % to about 40 wt % CNT, or between about 5 wt % to about 35 wt % CNT, or between about 10 wt % to about 20 wt % CNT, and between about 99 wt % to about 60 wt % PAC, or between about 95 wt % to about 65 wt % PAC, or between about 90 wt % to about 80 wt % PAC.

After preparing the thermally decomposable polymer composite which includes the thermally decomposable polymer composite, a plurality of fluoroplastic particles may be added to the thermally decomposable polymer composite to dilute the thermally decomposable polymer composite with the fluoroplastic particles to form a coating dispersion. The fluoroplastic particles added to the thermally decomposable polymer composite may be in solid form, for example in granular form. The fluoroplastic particles added to the thermally decomposable polymer composite may be in liquid form, particularly if the enthalpy of fusion (i.e., melting point or melting temperature) of the plurality of fluoroplastic particles is lower than the enthalpy of vaporization (i.e., vaporization point or vaporization temperature) of the PAC. In an embodiment, the fluoroplastic particles may be: polytetrafluoroethylene (PTFE); perfluoroalkoxy polymer resin (PFA), for example Teflon™ PFA; copolymers of tetrafluoroethylene (TFE); hexafluoropropylene (HFP); terpolymers of vinylidenefluoride and hexafluoropropylene; tetrapolymers of vinylidenefluoride, hexafluoropropylene, and tetrafluoroethylene; copolymers of at least two of vinylidenefluoride, hexafluoropropylene, and tetrafluoroethylene; and mixtures thereof. For simplicity of description, the present teachings will be described below with reference to a PFA fluoroplastic, but it will be understood that the described method may be modified for other fluoroplastic particles such as those listed.

In an embodiment, the coating dispersion (e.g., the CNT/PAC/PFA mixture) may include between about 2 wt % to about 20 wt % CNT/PAC, or between about 4 wt % to about 15 wt % CNT/PAC, or between about 6 wt % to about 10 wt % CNT/PAC, and between about 20 wt % to about 50 wt % PFA, or between about 25 wt % to about 45 wt % PFA, or between about 30 wt % to about 40 wt % PFA.

The PFA added to the thermally decomposable polymer composite may be added as solid PFA particles. In an embodiment, PFA particles may include an average diameter of between about 0.2 μm and about 30 μm, or between about 1 μm and about 20 μm, or between about 5 μm and about 15 μm. In an embodiment, the PFA particles may have a target diameter of about 10 μm to about 15 μm.

The coating dispersion may include other materials, such as one or more surfactants, for example a fluorinated surfactant, to enhance uniform mixing of the CNT/PAC/PFA materials, particularly the CNT within the PFA. In an embodiment, a methacrylate based fluorosurfactant may be used. In an embodiment, a GF4000 fluorinated surfactant, available from Toagosei of Tokyo, Japan may be dispensed within the coating dispersion to between about 0.1 wt % and about 5 wt %, or between about 0.5 wt % and about 3 wt %, or between about 1 wt % and about 2 wt % of PFA.

In an embodiment, the fluorinated surfactant and the plurality of fluoroplastic particles may be mixed to form the coating dispersion, wherein the fluorinated surfactant ranges from about 0.1 wt % to about 1.0 wt % of the fluoroplastic particles. In other words, comparing the fluorinated surfactant and the plurality of fluoroplastic particles (ignoring any other components), the wt % of the fluorinated surfactant is between about 0.1 wt % and about 1.0 wt % and the wt % of the plurality of fluoroplastic particles is between about 99.0 wt % and about 99.9 wt %.

The coating dispersion may also include one or more solvents (i.e., a solvent media), for example to tailor the viscosity of the coating dispersion for application onto a surface using a specific process such as flow coating or spray coating. The solvent media can include at least one of water, methanol, ethanol, isopropanol, acetone, methyl ethyl ketone (MEK), methyl isobutylketone (MIBK), cyclohexanone, N-Methyl-2-pyrrolidone (NMP), and mixtures thereof. If used, the solvent may be present in the coating dispersion to between about 10 wt % and about 90 wt %, or between about 20 wt % and about 80 wt %, or between about 30 wt % and about 70 wt %. In an embodiment, a solids component including the thermally decomposable polymer composite, the plurality of fluoroplastic particles, and the fluorinated surfactant can be mixed with the solvent media, wherein the solvent media ranges from about 10 wt % to about 80 wt % of the solids component. In other words, comparing the solvent media and the solids component comprising the thermally decomposable polymer composite, the plurality of fluoroplastic particles, and the fluorinated surfactant (ignoring any other components), the wt % of the solvent media is between about 10 wt % and about 80 wt % and the wt % of the solids component is between about 20 wt % and about 90 wt %.

After formation, the coating dispersion may be applied or dispensed onto a surface such as a surface of a printer fuser member, for example using flow coating or spray coating. In an embodiment, the coating dispersion is flow coated or spray coated onto a printer fuser member including a silicone rubber roll. In an embodiment, the coating dispersion is dispensed onto the silicone rubber roll at a temperature that is less than the melting temperature of the PFA, for example at a temperature of less than 300° C., or less than 200° C., or less than 100° C. During dispensing, the liquid PAC component functions as an adhesive to adhere the solid CNT and the granular PFA onto the silicone rubber roll. After dispensing and prior to curing, the coating dispersion can coat the fuser member.

After coating the fuser member, the coating dispersion may be processed to form a uniform coating on the fuser member, for example by rotating the fuser member about an axis at the dispensing temperature. The uniform coating dispersion will include solid particles of CNT and PFA, and a liquid PAC.

Next, the coated substrate, and thus the coating dispersion dispensed onto the surface, can be heated to a temperature above the melting temperature of the PFA to melt the solid PFA granules to liquefy the PFA. Further, because the melting temperature of the PFA is higher than the vaporization temperature of the PAC, the PAC is vaporized and thereby removed from the mixture during the melting of the PFA particles to form the final coating film to provide the fuser member topcoat. In an embodiment, the coating dispersion dispensed onto the surface may be heated to a baking temperature of above 300° C., for example to a temperature of between about 300° C. to about 375° C., or between about 300° C. and about 350° C. In another embodiment, the coated substrate, and thus the coating dispersion, can be heated to a temperature of between about 150° C. and about 350° C., or between about 200° C. and about 350° C., or between about 275° C. and about 325° C. to form the final coating film. The baking temperature may be maintained for a duration of between about 2 minutes and about 90 minutes, or between about 10 minutes and about 60 minutes, or between about 20 minutes and about 45 minutes.

In an embodiment, heating of the coating dispersion may include multiple heating stages. In a first stage, the solvent media can be evaporated by heating the coating dispersion on the coated substrate to a temperature of between about 100° C. and about 250° C., or between about 125° C. and about 225° C., or between about 150° C. and about 200° C. Subsequently, the thermally decomposable polymer binder can be decomposed by heating the coating dispersion on the coated substrate to a temperature of between about 200° C. and about 300° C., or between about 225° C. and about 290° C., or between about 240° C. and about 280° C. Next, the fluoroplastic particles can be melted by heating the coating dispersion to a temperature of between about 225° C. and about 375° C., or between about 250° C. and about 350° C., or between about 275° C. and about 325° C. In another embodiment, the coating dispersion can be processed to form the final coating film by heating the coated substrate to decompose the thermally decomposable polymer binder and melting the fluoroplastic particles by ramping the temperature of the coating dispersion to a temperature of about 350° C.

Because the PAC, for example a PPC PAC, decomposes sharply at about 250° C., the thermally decomposable polymer binder is removed from the coating dispersion during the melting of the PFA. In an embodiment, the PAC is completely removed from the topcoat such that the completed topcoat includes 0.0 wt % PAC. This effectively decreases a second amount of the thermally decomposable polymer binder within the final coating film from a first amount within the coating dispersion, wherein the second amount is between about 0.0% and about 5.0%, or between about 1.0% and about 5.0%, of the final coating film.

After heating the coating dispersion to melt the PFA and remove the PAC to form the final coating film, the substrate can be cooled to room temperature to solidify the PFA and complete the formation of the printer fuser member topcoat. In an embodiment, the completed topcoat, after heating to remove the PAC and cooling to solidify the PFA, may have a thickness of between about 2 μm and about 200 μm, or between about 10 μm and about 100 μm, or between about 20 μm and about 50 μm. In an embodiment, the completed topcoat may have a target thickness of about 10 μm to about 100 μm. In an embodiment, the final coating film may have a surface free energy of less than 30 N/m, or less than 25 N/m, or less than 20 N/m. In an embodiment, the final coating may have a thermal conductivity of greater than 0.101 W/mK as measured with a NanoFlash apparatus, available from Netzsch of Selb, Germany, at 25° C.

FIG. 1 depicts a completed fuser member 10 in accordance with an embodiment of the present teachings. The fuser member 10 can include a fuser roll 12, for example a silicone fuser roll, and a printer fuser member topcoat 14 in accordance with an embodiment discussed above. It will be recognized by one of ordinary skill in the art that FIG. 1 is a schematic depiction, and that a fuser member in accordance with the present teachings may include other structures which are not depicted for simplicity of explanation, while other structures may be removed or modified. Further, while FIG. 1 depicts a fuser roll, embodiments of the present teachings may include a cylinder, a belt, a plate, a film, a sheet, a drum, a drelt (i.e., a cross between a drum and a belt). Additionally, it will be understood that the fuser member may be installed in a printer.

Embodiments of the present teachings may therefore be used to form a uniform topcoat on a surface, where the topcoat includes CNT, for example a CNT powder, dispersed within a fluoroplastic. The resulting topcoat has sufficient thermal conductivity, electrical conductivity, wear resistance, and toner release properties. In an embodiment, the topcoat provides an acceptable oil-less release of a fused toner. The fluoroplastic topcoat including carbon nanotubes can be formed on a surface without exposing production personnel or end users to freestanding CNT powder. In an embodiment, the topcoat is fluoroelastomer free.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

The invention claimed is:

1. A method for forming a fluoroplastic coating, comprising:

mixing a plurality of carbon nanotubes with a thermally decomposable polymer binder to form a thermally decomposable polymer composite;

mixing the thermally decomposable polymer composite with a plurality of fluoroplastic particles, a fluorinated surfactant, and a solvent media to form a coating dispersion;

applying the coating dispersion onto a substrate to form a coated substrate; and heating the coated substrate to a temperature of from 150° C. to 350° C. to cure the coating dispersion to form a final coating film on the substrate.

2. The method of claim 1, further comprising forming the thermally decomposable polymer composite using a shear mixing process.

3. The method of claim 1, wherein forming the final coating film forms a final coating film having a surface free energy of less than 25 N/m.

4. The method of claim 1, wherein the thermally decomposable polymer binder comprises poly(alkylene carbonate) (PAC), wherein the PAC comprises a material selected from the group consisting of poly(propylene carbonate), poly(ethylene carbonate), poly(butylene carbonate), poly(cycloxene carbonate), and mixtures thereof.

5. The method of claim 1, wherein the heating of the coated substrate comprises:

evaporating the solvent media by heating the coating dispersion on the coated substrate to a temperature of between about 150° C. to about 200° C.;

decomposing the thermally decomposable polymer binder by heating the coating dispersion on the coated substrate to a temperature of between about 240° C. to about 280° C.; and melting the fluoroplastic particles within the coating dispersion by heating the coating dispersion on the coated substrate to a temperature of between about 250° C. to about 350° C. to form a final coating.

6. The method of claim 1, wherein the heating of the coated substrate comprises decomposing the thermally decomposable polymer binder and melting the fluoroplastic particles by ramping a temperature of the coating dispersion to a temperature of about 350° C.

7. The method of claim 1, wherein the heating of the coated substrate decreases a second amount of the thermally decomposable polymer binder within the final coating film which is less than a first amount of the thermally decomposable polymer binder within the coating dispersion, wherein the second amount comprises between about 0 wt % and about 5.0 wt % within the final coating film.

8. The method of claim 1, wherein the plurality of fluoroplastic particles are selected from the group consisting of:

polytetrafluoroethylene (PTFE); perfluoroalkoxy polymer resin (PFA); copolymers of tetrafluoroethylene (TFE); hexafluoropropylene (HFP); terpolymers of vinylidenefluoride and hexafluoropropylene; tetrapolymers of vinylidenefluoride, hexafluoropropylene, and tetrafluoroethylene; copolymers of at least two of vinylidenefluoride, hexafluoropropylene, and tetrafluoroethylene; and mixtures thereof.

9. The method of claim 1, wherein the fluorinated surfactant comprises a methacrylate based fluorosurfactant.

10. The method of claim 1, wherein the solvent media is selected from the group consisting of water, methanol, ethanol, isopropanol; acetone, methyl ethyl ketone (MEK), methyl isobutylketone (MIBK), cyclohexanone, N-Methyl-2-pyrrolidone (NMP), and mixtures thereof.

11. The method of claim 1, further comprising mixing the carbon nanotubes and the plurality of fluoroplastic particles to form the coating dispersion, wherein the carbon nanotubes range from about 0.5 wt % to about 15 wt % of the fluoroplastic particles.

12. The method of claim 1, further comprising mixing the thermally decomposable polymer binder and the fluoroplastic particles to form the coating dispersion, wherein the decomposable polymer binder ranges from 10 wt % to about 99 wt % of the fluoroplastic particles.

13. The method of claim 1, further comprising mixing the fluorinated surfactant and the fluoroplastic particles to form the coating dispersion, wherein the fluorinated surfactant ranges from about 0.1 wt % to about 1.0 wt % of the fluoroplastic particles.

14. The method of claim 1, further comprising mixing a solids component comprising the thermally decomposable polymer composite, the plurality of fluoroplastic particles and the fluorinated surfactant with the solvent media, wherein the solvent media ranges from about 10 wt % to about 80 wt % of the solids component.

15. A method for forming a printer fuser member substrate comprising a topcoat, wherein the topcoat is formed using a method comprising:

mixing a plurality of carbon nanotubes with a thermally decomposable polymer binder to form a thermally decomposable polymer composite;

mixing the thermally decomposable polymer composite with a plurality of fluoroplastic particles, a fluorinated surfactant, and a solvent media to form a coating dispersion;

applying the coating dispersion onto a fuser member substrate to form a coated fuser member substrate; and heating the coated fuser member substrate to a temperature of from 150° C. to 350° C. to cure the coating dispersion to form a final coating film on the fuser member substrate.

16. The method of claim 15, wherein forming the final coating film forms a final coating film having a surface free energy of less than 25 N/m.

17. The method of claim 15, wherein the thermally decomposable polymer binder comprises poly(alkylene carbonate) (PAC), wherein the PAC comprises a material selected from the group consisting of poly(propylene carbonate), poly(ethylene carbonate), poly(butylene carbonate), poly(cycloxene carbonate), and mixtures thereof.

18. The method of claim 15, wherein the heating of the coated fuser member substrate decreases a second amount of the thermally decomposable polymer binder within the final coating film which is less than a first amount of the thermally decomposable polymer binder within the coating dispersion, wherein the second amount comprises between about 0 wt % to about 5.0 wt % within the final coating film.

* * * * *